US006235990B1

(12) United States Patent
Morris et al.

(10) Patent No.: US 6,235,990 B1
(45) Date of Patent: May 22, 2001

(54) MODULAR RETRACTILE TELEPHONE CORDS

(75) Inventors: Jeffrey M. Morris, Buffalo Grove; Yong R. Chu, Itasca, both of IL (US)

(73) Assignee: Telephone Products, Inc., Wheeling, IL (US)

( * ) Notice: Subject to any disclaimer, the term of this patent is extended or adjusted under 35 U.S.C. 154(b) by 0 days.

(21) Appl. No.: 09/235,616

(22) Filed: Jan. 5, 1999

Related U.S. Application Data

(63) Continuation-in-part of application No. 09/135,372, filed on Aug. 17, 1998.

(51) Int. Cl.[7] ..... H01B 7/06

(52) U.S. Cl. ..... 174/69; 174/110 SR; 174/137 B; 428/383

(58) Field of Search ..... 174/69, 137 B, 174/110 SR, 113 T, 68.1, 136

(56) References Cited

U.S. PATENT DOCUMENTS

| | | | | |
|---|---|---|---|---|
| 1,937,981 | | 12/1933 | Rosenthal | 173/387 |
| 2,704,782 | | 3/1955 | Ames | 174/69 |
| 2,795,641 | | 6/1957 | Rowell | 174/135 |
| 3,854,002 | * | 12/1974 | Glander et al. | 174/69 |
| 3,993,860 | | 11/1976 | Snow et al. | 174/69 |
| 4,227,042 | | 10/1980 | Lueddecke et al. | 174/120 |
| 4,346,145 | | 8/1982 | Choi et al. | 428/389 |
| 4,375,012 | | 2/1983 | Cocco et al. | 174/69 |
| 4,490,575 | * | 12/1984 | Kutnyak | 174/47 |
| 4,551,185 | | 11/1985 | Loesch | 148/150 |
| 4,582,867 | | 4/1986 | Choi et al. | 524/115 |
| 4,592,955 | | 6/1986 | Choi et al. | 428/389 |
| 4,656,091 | | 4/1987 | Choi et al. | 428/383 |
| 4,683,349 | | 7/1987 | Takebe | 174/69 |
| 4,705,823 | | 11/1987 | Choi et al. | 524/474 |
| 4,910,359 | | 3/1990 | Dougherty et al. | 174/69 |
| 5,087,521 | | 2/1992 | Choi et al. | 428/389 |
| 5,340,652 | * | 8/1994 | Sondhe et al. | 428/413 |
| 5,635,559 | * | 6/1997 | Brock et al. | 524/839 |

FOREIGN PATENT DOCUMENTS

| | | | | |
|---|---|---|---|---|
| 1 229 442 | | 4/1971 | (GB) . | |
| 1311118 | * | 3/1973 | (GB) | H01B/7/06 |

* cited by examiner

*Primary Examiner*—Dean A. Reichard
*Assistant Examiner*—Adolfo Nino
(74) *Attorney, Agent, or Firm*—Welsh & Katz, Ltd.; Thomas W. Tolpin

(57) ABSTRACT

A convenient compact telephone cord with a special coil diameter and a much smaller relaxed retracted length reduces sagging, occupies less space, and is much more attractive than conventional saggy telephone cords. The user-friendly high performance telephone cord has a core of electrical conductors which are insulated by primary insulation and are encased within an insulating jacket to meet or exceed national and international telephone standards and requirements. In the preferred form, the primary insulation comprises polypropylene and the insulating jacket comprises polyurethane and most preferably a blend of polyurethane and ethylene vinyl acetate. Desirably, the telephone cord comprises a modular retractile telephone cord with at least one modular plug. The attractive space-saving telephone cord can be used with handsets, headsets, vehicle phones, modems, and computers.

28 Claims, 2 Drawing Sheets

MODULAR RETRACTILE TELEPHONE CORDS

RELATED APPLICATIONS

This application is a continuation-in-part of U.S. Application Ser. No. 09/135,372 filed Aug. 17, 1998 of Jeffrey M. Morris and Yong R. Chu for Modular Retractile Telephone Cords, presently assigned to Group Art Unit 2831.

BACKGROUND OF THE INVENTION

This invention pertains to telephone cords and, more particularly, to modular telephone cords.

Telephone cords are usually wound and coiled on mandrels to form spirals. Desirably, spiral telephone cords can be extended when using the telephones to which they are connected, and can be returned to their original retracted position when the telephones are not in use. Telephone cords have many uses.

Telephone cords used to connect a handset to a base should have sufficient retractility to insure that they will return in a controlled gradual manner to their normal retracted position after having been extended and released. Coiled or spiral telephone cords, however, which also known as "spring cords" or "retractile cords" should not be so strongly retractile that they require excessive forces to extend the telephone cord. If the telephone cord is too unyielding, the telephone handset or device to which the telephone cord is connected may be removed on or pulled from its support. While excessive retractility should be avoided, a telephone cord should not be made so stretchable that its distended spirals fail to return to their retracted position after using the telephone. This is especially important in order to prevent unsightly, excessive sag of telephone cords which are used on wall-mounted telephones. Furthermore, it is desirable that the retracted length of the telephone cord be as short as possible so as to be unobtrusive and avoid taking up excessive space and being distractive. In order to avoid this situation, telephone cords that are connected to telephone handsets must extend easily, perform dependably, and be as short as possible in their retracted position.

Retractable telephone cords are often constructed of cordage of individually insulated, mandrelated flexible conductor comprising tinsel ribbons. Conventional telephone cords are also often covered with nylon, insulated with polyvinyl chloride (PVC), and jacketed with a PVC composition in a circular configuration.

Telephone cords which utilize modular plugs for terminating the cord conductors are known as "modular telephone cords" . Jacks adapted to receive the modular plugs are mounted in the telephone housing or base and in a wall terminal thereby permitting easy replacement of either the line or retractile cord by a customer or an installer. Modular telephone cords have become very popular with consumers and telephone serviceman because of their ease of use and interchangeability.

The popularity of modular telephone cords with its associated plug-terminated cordage inspired the development of telephone cordage having a smaller cross-section than that used in the past. Conventional telephone cordage design suitable for use with modular plugs typically have smaller conductors arranged in a parallel relationship, positioned in a single plane, and encapsulated with a flattened oval-shaped jacket. To reduce the size of the insulated conductor, the knitted nylon covering the tinsel conductors was often eliminated and replaced with a crystalline thermoplastic elastomer.

It has been found that if top coated cordage is formed into a spring cord configuration, it has excellent retractile properties. However, when top-coated cordage is formed on mandrels of automatic cord making apparatus, the finished cords are so strongly retractile that excessive forces are required to stretch and expand the telephone cord. This problem occurs not only because of the top coating but also because of the relatively small diameter of the convolutions of the cordage. The diameter which is about 0.64 cm has been increased by forming the convolutions on larger diameter mandrels to achieve a top-coated cord having a larger diameter such as for example on the order of 0.95 cm. Although such prior art cords are suitably extensible, they lack good retractility. This is particularly noticeable in prior telephone cords which are used on wall-mounted telephones and which are desired to have an extended length of 7.6 meters and a retracted length of about 1 meter.

It is, therefore, desirable to provide improved modular retractile telephone cords which overcome most, if not all, of the preceding problems.

SUMMARY OF THE INVENTION

An improved telephone cord is provided which is compact, reliable, and economical. Advantageously, the space-saving telephone cord reduces sagging, is less obtrusive, and occupies a smaller area than conventional bulky saggy telephone cords. The attractive space-saving telephone cord is easy-to-use, convenient and effective. Desirably, the user-friendly telephone cord complies with telephone standards and requirements in the United States, Europe, Japan, and other countries. The novel telephone cord also achieved unexpected surprisingly good results.

The inventive telephone cord can be used as: a telephone handset cord for use with telephone handsets, a telephone headset cord for use with telephone headsets, a telephone vehicle cord for use with car phones or vehicles phones, a data transmission or receiving cord such as a telephone computer cord for use with a microprocessor, computer or central processing unit (CPU), or a telephone modem cord for use with a modem.

The telephone cord preferably comprises a modular retractile (retractable) telephone cord with at least one modular telephone plug at one end. The other end of the telephone cord can be connected to another modular telephone plug, or a different plug, or hardwire or otherwise connected to a telephone line or other circuitry. The modular telephone plug snap fits into a socket, jack, receptacle or other complementary-shaped female connector, in a telephone handset, base unit, wall receptacle, headset, etc.

The retractile telephone cord has a core comprising 2 to 8 conductors, preferably 4 to 7 conductors. For data transmission or receiving telephone cords, it is preferred that the conductors are twisted. For voice transmission or receiving telephone cords, it is preferred that the conductors are substantially parallel. The conductor can comprise wires, strands, or a flexible tinsel ribbon.

The conductors can be electrically insulated, isolated and separated from each other by primary insulation. The primary insulation can comprise an insulating material such as: a crystalline thermoplastic elastomer, polyethylene, polyvinyl chloride (PVC), nylon (polyamide), neoprene (polychloroprene)(polymerized chloroprene), polyurethane, polyurethane diisocyanate, urethane, butadiene, polystyrene, natural rubber (natural polyisoprene), styrene butadiene, acrobonitrile-butadiene, butyl rubber, vulcanized Hevea, Buna S, polysulfone, silicone, polysiloxane, chlorosulfanated polyethylene, or preferably polypropylene.

The retractile telephone cord can have a unitary or composite outer protective jacket positioned about the primary insulation and core. The outer protective jacket provides secondary insulation and can comprise an elastomeric insulating material, such as: polytetrafluroethylene (PTFE) (Teflon), polyvinyl chloride, nylon, neoprene, butadiene, polystyrene, styrene butadiene, acrolonitrile-butadiene, butyl rubber, vulcanized Hevea, Buna S, polysylfone, silicone, natural rubber, polyethylene, polypropylene, chlorosulfanated polyethylene, polysiloxane, or preferably polyurethane, polyurethane diisocyanate, or urethane, and most preferably, a blend of polyurethane and ethylene vinyl acetate (EVA). If desired, at least part of the jacket can be coated with another elastomeric insulating material.

The retractile telephone cord has a coiled portion between the ends of the cord. The coiled portion can be wound or coiled into spirals or helixes. The coiled portion has coils which have a maximum outside coil diameter when the telephone cord is in a relaxed retracted position. The coiled portion can be uniform and even in which all the coils have the same uniform maximum outside coil diameter. The coiled portion can also be tapered in which at least some of the coils have a different maximum outside coil diameter. Advantageously, the maximum outside coil diameter of the compact telephone cord is greater than 0.5 inches (12.07 mm), preferably at least 0.75 inches (19.05 mm), and most preferably at least one inch (245 mm). As used in this application, the terms "maximum coil diameter" and "maximum outside coil diameter" mean the maximum transverse span or the maximum outside diameter of the particular coil, spiral, helix, or loop of the telephone cord when the telephone cord is relaxed, unpulled, unstretched or retracted.

The compact retractile telephone cord can have a nominal uncoiled total length of 6 feet (1.8288 m), 12 feet (3.6576 m), or 25 feet (7.26 m), but has a much smaller relaxed retracted length than conventional telephone cords. The telephone cord can be expanded to an extended length of 790 to 7240 mm, preferably at least 1880 mm. The compact telephone cord can have a normal relaxed retracted length or recovered length of 70 to 1470 mm, preferably 150 to 648 mm. In the illustrative embodiment, the telephone cord had a recovered length ranging from 70 to 1140 mm after being subjected to a load of 170 gm for 300 seconds.

A more detailed explanation of the invention is provided in the following description and appended claims taken in conjunction with the accompanying drawings.

DETAILED DESCRIPTION OF THE PREFERRED EMBODIMENTS

Compact space-saving large diameter modular retractile (retractable) telephone cords 10, 32 and 50 (FIGS. 1, 3, and 5) are provided with much smaller relaxed retracted lengths to reduce unsightly sagging and occupy much less space than previous conventional telephone cords.

Figure 6:
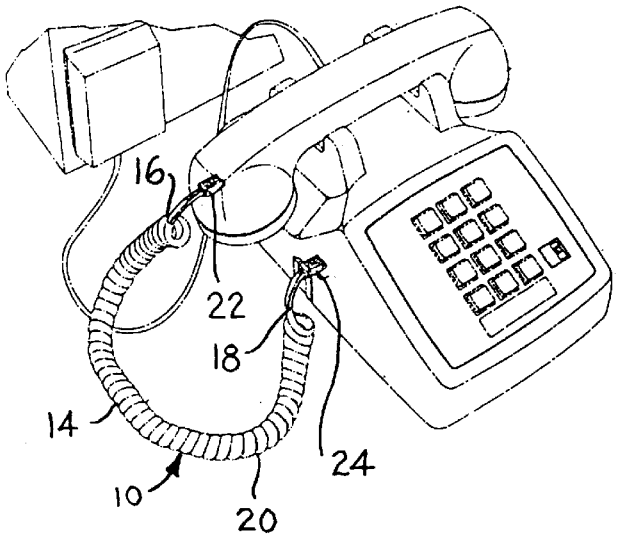
FIG. 6 is a perspective view of a modular telephone cord connected to a telephone for positioning on a table.

The telephone cord 10 (FIGS. 1 and 6) can comprise a telephone handset cord for connecting a telephone handset to a telephone base unit. The telephone handset cord comprises a modular retractile telephone cord which provides a cordage assembly 12 with a spiral wound coiled portion 14 that extends between and is connected to a handset-facing end 16 and a base-facing end 18 of the telephone cord. The spiral wound coiled portion comprises a series, set, or array of coils 20 which provide loops. The coil preferably comprise spiral coils (spirals), and most preferably helical coils (helixes).

The modular telephone cord has at least one modular plug 22 (FIG. 1) connected to one of the ends of the telephone cord, and preferably has two plastic modular telephone plugs 22 and 24 connected to opposite ends of the telephone cord. The telephone handset cord has a handset-connecting modular plug 22 which is connected to the handset-facing end of the telephone cord and has a base-connecting modular plug 24 which is connected to the base-facing end of the telephone cord. The handset-connecting modular plug provides a telephone handset connector which snap fits and interlockingly engages, as well as can be detachably secured and removably connected to a complementary-shaped female socket or jack of a telephone handset. The base-connecting modular plug provides a base unit connector which snap fits and interlockingly engages, as well as can be detachably secured and removably connected to a complementary-shaped female socket or jack of a telephone base unit.

Each of the modular plugs has a wedging cantilevered connecting arm 26 or 27 (FIG. 1) which is connected to and normally biased outwardly at an angle of inclination away from the front nose 28 or 29 of the head 30 or 31 or body of the modular plug. The connecting arm extends generally towards the coiled portion of the telephone cord, but normally diverges away from the end of the cord to which the modular plug is connected. The connecting arm can be squeezed and pivoted toward and against the side of the head or body of the modular plug, when the modular plug is inserted or removed from a socket or jack of a handset, base unit, headset, wall receptacle, computer, modem, appliance, or other apparatus. When inserted into a complementary socket or jack, the connecting arm of the modular plug securely wedges against, snap fits, and lockably engages the adjoining wall portious of the socket or jack.

The modular retractile telephone cord is biased in a normally relaxed retracted position to a collapsed retracted length when the telephone cord is stored, awaiting use, unstretched, unpulled, relaxed, and retracted. The modular retractile telephone cord can be expanded to an elongated stretched extended position to an extended length when the telephone cord is pulled, stretched, and extended. The telephone handset cord is biased and urged in a normally relaxed position when the handset is cradled or seated on the base unit when the telephone is not in use and no voice signals or data pulses are being sent (transmitted) or received. The telephone handset cord is expanded to an elongated stretched extended position when the handset is moved away from the base unit when the telephone is in use and voice signals or data pulses are being transmitted or received. Preferably, the extended length is at least 5 times greater than the retracted length of the telephone cord. Desirably, the retracted length of the telephone cord is less than 15%, preferably less than 10%, of the extended length of the telephone cord. The telephone cords are preferably produced in nominal total uncoiled lengths of 6 feet (ft.) (1.8288 m), 12 ft. (3.6576 m) and 25 ft. (7.62 m).

The coils of the modular telephone cord have a greater maximum coil diameter and are positioned closer together when the telephone cord is in a relaxed retracted position. The coils have a maximum coil diameter of 0.5 inches (12.07 mm), preferably at least 0.75 inches (19.09 mm), and most preferably at least one inch, (25.55 mm), when the telephone cord is in a retracted position. In the telephone cord of FIG. 1, the coiled portion is uniform and comprise uniform coils, preferably spiral coils, and most preferably helical coils, having the same maximum coil diameter when the telephone cord is in the retracted position. Conversely, the coils have a smaller coil diameter and are positioned farther apart when the telephone cord is stretched or expanded to its maximum extended position.

Figure 1:
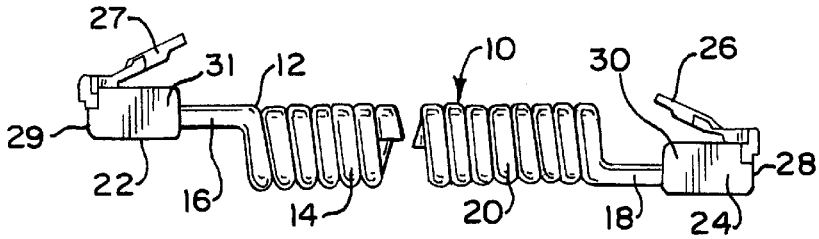
FIG. 1 is a front view of a modular telephone cord for voice transmission and receiving with a uniform diameter coiled portion in accordance with principles of the present invention.
Figure 3:
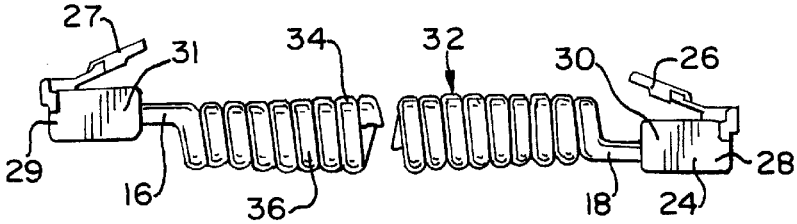
FIG. 3 is a front view of a modular telephone cord for voice transmission and receiving with a tapered coiled portion in accordance with principles of the present invention.
Figure 7:
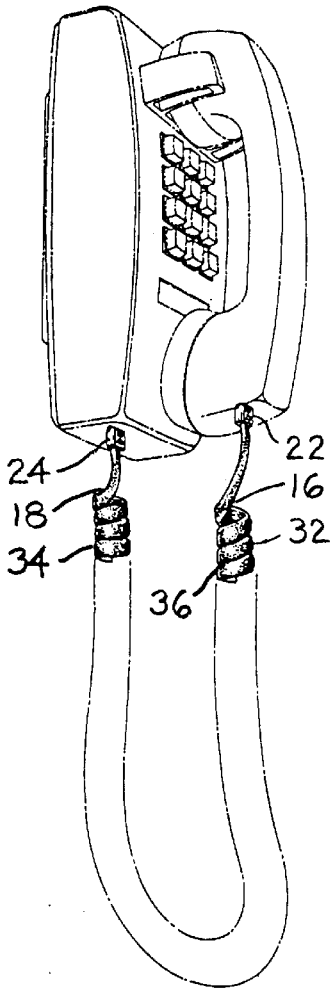
FIG. 7 is a perspective view of a modular telephone cord connected to a wall-mounted telephone.

The modular telephone cord 32 of FIGS. 3 and 7 is structurally and functionally similar to the modular telephone cord of FIG. 1, except that the coiled portion comprises a sloping bulging barrel-shaped tapered coiled portion 34 in which the coils 36 gradually taper, increase or decrease in size. At least some of the coils of the tapered coil portion have different maximum coil diameters when the telephone cord is in a retracted position.

The cordage assembly of the modular telephone cord can comprise a core 40 (FIG. 2) with 2 to 8 and preferably 4 to 7 electrical conductors 42. For voice transmission and receiving, the conductors preferably comprise parallel flexible electrical conductors, most preferably flexible tinsel ribbon 44 comprising flexible tinsel wire strands. The tinsel ribbon can be made of phosphorous bronze or other suitable conductive material.

Figure 4:
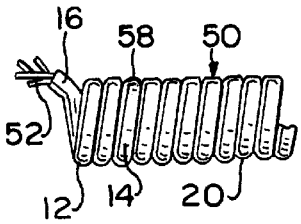
FIG. 4 is an enlarged cross-sectional view of a modular telephone cord for data transmission and receiving.
Figure 5:
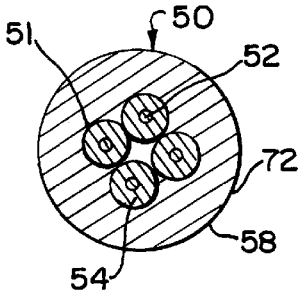
FIG. 5 is a fragmentary front view of the modular telephone cord of FIG. 4 without the modular plugs and illustrating the twisted conductors of the interior core.

The modular telephone cord 50 of FIGS. 4 and 5 are structurally and functionally similar to the modular telephone cord of FIG. 1, except that the conductors of the core 51 are twisted to form twisted conductors 52 which provide a cable to transmit and receive data. In one preferred form, each of the conductors comprise 26–28 AWG (American Wire Gauge) wire and have a diameter ranging from 0.015 inches (0.38 mm) to 0.024 inches (0.61 mm). Preferably, the conductors have a tensile pull strength of at least 44.5 N.

Figure 2:
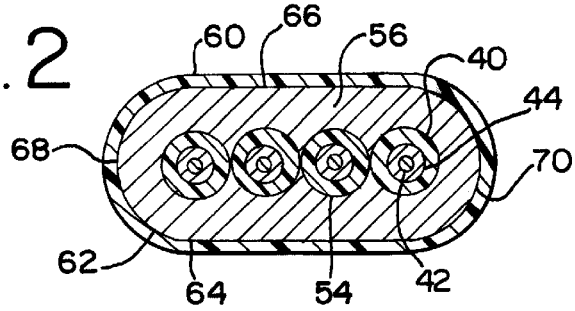
FIG. 2 is an enlarged cross-sectional view of the modular telephone cord of FIG. 1.

The electrical conductors are electrically insulated, isolated, and physically separated from each other by primary insulation 54 (FIGS. 2 and 4). In the preferred form, the primary insulation comprises polypropylene, has an insulation resistance more than 150 Ω·km, and has a dielectric constant at $10^6$ Hz of 2.20–2.28. The dielectric strength between conductors is such that there is no breakdown at 1000 VAC for one minute. Preferably, the primary insulation has a wall thickness greater than 0.004 inches (0.1016 mm).

The cordage assembly of the modular telephone cord has an outer protective jacket 56 or 58 (FIGS. 2 and 4) which provides a secondary insulation and an electrical insulation sheath that annularly surrounds, encloses and encases the primary insulation and core of conductors. In the preferred form, the outer protective jacket comprises urethane or most preferably polyurethane, with a dielectric constant at $10^6$ Hz of 5–8. Desirably, the outer protective jacket comprises a blend of polyurethane and ethylene vinyl acetate (EVA), such as by weight: 80% polyurethane and 20% EVA, and preferably, 90% polyurethane and 10% EVA. The composite outer protective jacket can comprise by weight: 50%–99% polyurethane and 1%–50% EVA. Preferably, the outer protective jacket has a wall thickness greater than 0.1 inches (2.54 mm) and a tensile strength greater than 1200 psi (84,368,35 g/cm $^2$). If desired, part or all of the exterior surface of the outer protective jacket can be coated with an elastomeric insulating layer 60 (coating) (FIG. 2), such as a 0.005 cm layer of polyester or other plastic, to enhance protection, insulation, and retractility. The outer protective jacket 56 (FIG. 2), enclosing the parallel conductors preferably has a generally elliptical or oval exterior surface 62, periphery and shape. The outer protective jacket 56 positioned about the parallel conductors can also have parallel elongated sides 64 and 66 and curved arcuate ends 68 and 70. The outer protective jacket 58 (FIG. 4) enclosing and positioned about the twisted conductors can have a circular exterior surface 72, periphery and shape.

The illustrated modular telephone cords can also be used as: telephone headset cords for use with telephone headsets, telephone vehicle cords for use with car phones or vehicle phones, data transmission or receiving cords such as telephone computer cords for use with microprocessors, central processing units (CPUs), and computers, or telephone modem cords for use with modems.

EXAMPLES 1–8

Retractile telephone cords of the type described above were formed with a maximum outside coil diameter of 0.75 inches (19.05 mm). The telephone cords had a uniform outside coil diameter as shown in FIG. 1. The telephone cords were also constructed with an oval cross-sectional configuration with elongated flattened sides as shown in FIG. 2 and had an interior core comprising four flexible tinsel copper conductors. The conductors were insulated with a polypropylene primary insulation.

Telephone cords 1–3 had an outer protective jacket consisting essentially of polyurethane. Telephone cords 4–6 had an outer protective jacket consisting essentially of polyvinyl chloride (PVC). Telephone cords 7 and 8 had composite outer protective jacket consisting essentially of by weight: 90% polyurethane and 10% ethylene vinyl acetate (EVA). Telephone cords 1 and 4 had a total nominal uncoiled length of 6 feet (1.8288 mm). Telephone cords 2, 5 and 7 had a total nominal uncoiled length of 12 feet (3.6576 m). Telephone cords 3, 6 and 8 had a total nominal uncoiled length of 25 feet (7.26 m).

The telephone cords had a retracted length as shown in Table 1 as follows:

TABLE 1

| Example No. | Retractile Telephone Cord | Total Nominal Uncoiled Length (feet) | Outer Protective Jacket | Retracted Length (mm) |
|---|---|---|---|---|
| | | Retracted Length | | |
| 1 | 1 | 6 (1.8288 m) | Polyurethane | 150 |
| 2 | 2 | 12 (3.6576 m) | Polyurethane | 287 |
| 3 | 3 | 25 (7.26 m) | Polyurethane | 848 |
| 4 | 4 | 6 (1.8288 m) | PVC | 197 |
| 5 | 5 | 12 (3.6576 m) | PVC | 288 |

TABLE 1-continued

| Retracted Length | | | | |
|---|---|---|---|---|
| Example No. | Retractile Telephone Cord | Total Nominal Uncoiled Length (feet) | Outer Protective Jacket | Retracted Length (mm) |
| 6 | 6 | 25 (7.26 m) | PVC | 880 |
| 7 | 7 | 12 (3.6576 m) | Polyurethane + EVA | 305 |
| 8 | 8 | 25 (7.26 m) | Polyurethane + EVA | 660 |

It is evident from Examples 1–8 that telephone cords with 100% polyurethane jackets had a smaller retracted length than telephone cords with PVC jackets.

EXAMPLES 9–16

The retractile telephone cords of Examples 1–8 were expanded and stretched to a maximum extended position as indicated in Table 2 below, without interfering with their ability to return to their normal unstretched retracted position.

TABLE 2

| Extended Length | | | | |
|---|---|---|---|---|
| Example No. | Retractile Telephone Cord | Total Nominal Uncoiled Length (feet) | Outer Protective Jacket | Extended Length (mm) |
| 9 | 1 | 6 (1.8288 m) | Polyurethane | 1660 |
| 10 | 2 | 12 (3.6576 m) | Polyurethane | 3420 |
| 11 | 3 | 25 (7.26 m) | Polyurethane | 7240 |
| 12 | 4 | 6 (1.8288 m) | PVC | 1620 |
| 13 | 5 | 12 (3.6576 m) | PVC | 3380 |
| 14 | 6 | 25 (7.26 m) | PVC | 7080 |
| 15 | 7 | 12 (3.6576 m) | Polyurethane + EVA | 3404 |
| 16 | 8 | 25 (7.26 m) | Polyurethane + EVA | 7163 |

It is evident from Examples 9–16 that telephone cords with 100% polyurethane jackets and with composite jackets of polyurethane and ethylene vinyl acetate (EVA) have a greater extended length than telephone cords with PVC jackets.

EXAMPLES 17–57

Retractile telephone cords were formed and constructed as described in Examples 1–8 and were hung vertically. The top ends of the telephone cords were secured and fixed in a stationary position. Weights were connected and added to the bottoms of the telephone cords to stretch, extend, and expand the telephone cords an additional length of 0.3 m, 1.0 m, 1.2 m, 1.5 m, 1.7 m, and 1.8 m as indicated in Table 3 below. The amount of weights (load) required to stretch, extend and expand the telephone cords to the additional lengths are also shown in Table 3 below.

TABLE 3

| Additional Length and Load | | | | | |
|---|---|---|---|---|---|
| Example No. | Telephone Cord | Total Normal Uncoiled Length (Feet) | Outer Protective Jacket | Additional Length (m) | Load (gm) |
| 17 | 1 | 6 (1.8288 m) | Polyurethane | 0.3 | 72 |
| 18 | 1 | 6 (1.8288 m) | Polyurethane | 1.0 | 180 |
| 19 | 1 | 6 (1.8288 m) | Polyurethane | 1.2 | 270 |
| 20 | 2 | 12 (3.6576 m) | Polyurethane | 0.3 | 80 |
| 21 | 2 | 12 (3.6576 m) | Polyurethane | 1.0 | 115 |
| 22 | 2 | 12 (3.6576 m) | Polyurethane | 1.2 | 140 |
| 23 | 2 | 12 (3.6576 m) | Polyurethane | 1.5 | 150 |
| 24 | 2 | 12 (3.6576 m) | Polyurethane | 1.7 | 175 |
| 25 | 2 | 12 (3.6576 m) | Polyurethane | 1.8 | 180 |
| 26 | 3 | 25 (7.26 m) | Polyurethane | 0.3 | 110 |
| 27 | 3 | 25 (7.26 m) | Polyurethane | 1.0 | 150 |
| 28 | 3 | 25 (7.26 m) | Polyurethane | 1.2 | 152 |
| 29 | 3 | 25 (7.26 m) | Polyurethane | 1.5 | 155 |
| 30 | 3 | 25 (7.26 m) | Polyurethane | 1.7 | 160 |
| 31 | 3 | 25 (7.26 m) | Polyurethane | 1.8 | 165 |
| 32 | 4 | 6 (1.8288 m) | PVC | 0.3 | 70 |
| 33 | 4 | 6 (1.8288 m) | PVC | 1.0 | 160 |
| 34 | 5 | 12 (3.6576 m) | PVC | 0.3 | 80 |
| 35 | 5 | 12 (3.6576 m) | PVC | 1.0 | 110 |
| 36 | 5 | 12 (3.6576 m) | PVC | 1.2 | 140 |
| 37 | 5 | 12 (3.6576 m) | PVC | 1.5 | 150 |
| 38 | 5 | 12 (3.6576 m) | PVC | 1.7 | 160 |
| 39 | 5 | 12 (3.6576 m) | PVC | 1.8 | 165 |
| 40 | 6 | 25 (7.26 m) | PVC | 0.3 | 110 |
| 41 | 6 | 25 (7.26 m) | PVC | 1.0 | 145 |
| 42 | 6 | 25 (7.26 m) | PVC | 1.2 | 150 |
| 43 | 6 | 25 (7.26 m) | PVC | 1.6 | 155 |
| 44 | 6 | 25 (7.26 m) | PVC | 1.7 | 160 |
| 45 | 6 | 25 (7.26 m) | PVC | 1.8 | 165 |
| 46 | 7 | 12 (3.6576 m) | Polyurethane + EVA | 0.3 | 80 |
| 47 | 7 | 12 (3.6576 m) | Polyurethane + EVA | 1.0 | 130 |
| 48 | 7 | 12 (3.6576 m) | Polyurethane + EVA | 1.2 | 140 |
| 49 | 7 | 12 (3.6576 m) | Polyurethane + EVA | 1.5 | 150 |
| 50 | 7 | 12 (3.6576 m) | Polyurethane + EVA | 1.7 | 180 |
| 51 | 7 | 12 (3.6576 m) | Polyurethane + EVA | 1.8 | 185 |
| 52 | 8 | 25 (7.26 m) | Polyurethane + EVA | 0.3 | 110 |
| 53 | 8 | 25 (7.26 m) | Polyurethane + EVA | 1.0 | 180 |
| 54 | 8 | 25 (7.26 m) | Polyurethane + EVA | 1.2 | 150 |
| 55 | 8 | 25 (7.26 m) | Polyurethane + EVA | 1.5 | 155 |
| 56 | 8 | 25 (7.26 m) | Polyurethane + EVA | 1.7 | 160 |
| 57 | 8 | 25 (7.26 m) | Polyurethane + EVA | 1.8 | 165 |

EXAMPLES 58–65

Retractile telephone cords were formed and constructed as described in Example 1–8. The top ends of the telephone cords were secured and fixed in a stationary position. Loads (weights) of 170 gm were connected and added to the bottom of the telephone cords for 60 seconds to stretch, extend, and expand the telephone cords to the loaded lengths indicated in Table 4 below:

TABLE 4

Extension Tests

| Example No. | Retractile Telephone Cords | Total Nominal Uncoiled Length (Feet) | Outer Protective Jacket | Loaded Length |
|---|---|---|---|---|
| 58 | 1 | 6 (1.8288 m) | Polyurethane | 790 |
| 59 | 2 | 12 (3.6576 m) | Polyurethane | 2270 |
| 60 | 3 | 25 (7.26 m) | Polyurethane | 3390 |
| 61 | 4 | 6 (1.8288 m) | PVC | 1005 |
| 62 | 5 | 12 (3.6576 m) | PVC | 2340 |
| 63 | 6 | 25 (7.26 m) | PVC | 3890 |
| 64 | 7 | 12 (3.6576 m) | Polyurethane + EVA | 1651 |
| 65 | 8 | 25 (7.26 m) | Polyurethane + EVA | 4089 |

It appears from Examples 58–65 that the loaded lengths of telephone cords with 100% polyurethane jackets and with composite jackets of polyurethane and ethylene vinyl acetate (EVA) are smaller than the loaded lengths of telephone cords with PVC jackets.

EXAMPLES 66–73

Retractile telephone cords were formed and constructed as described in Examples 1–8. The top ends of the telephone cords were secured and fixed in a stationary position. Loads (weights) of 170 gm were hung from the bottoms of the telephone cords for 300 seconds. The loads (weights) were than removed and the bottom ends of the telephone cords moved upwardly as the telephone cords retracted to the recovered lengths indicated in Table 5 below.

TABLE 5

Recovery Tests

| Example No. | Retractile Telephone Cord | Total Nominal Uncoiled Length (Feet) | Outer Protective Jacket | Recovered Length (mm) |
|---|---|---|---|---|
| 66 | 1 | 6 (1.8288 m) | Polyurethane | 70 |
| 67 | 2 | 12 (3.6576 m) | Polyurethane | 283 |
| 68 | 3 | 25 (7.26 m) | Polyurethane | 1140 |
| 69 | 4 | 6 (1.8288 m) | PVC | 145 |
| 70 | 5 | 12 (3.6576 m) | PVC | 460 |
| 71 | 6 | 25 (7.26 m) | PVC | 1470 |
| 72 | 7 | 12 (3.6576 m) | Polyurethane + EVA | 305 |
| 73 | 8 | 25 (7.26 m) | Polyurethane + EVA | 660 |

Examples 66–73 clearly indicate that the recovered lengths of telephone cords with 100% polyurethane jackets and with composite jackets of polyurethane and ethylene vinyl acetate (EVA) are smaller than telephone cords with PVC jackets.

EXAMPLES 74–81

Retractile telephone cords were formed and constructed as described in Examples 1–8. The top ends of the telephone cords were secured and fixed in a stationary position. The telephone cords were each stretch, expanded, and extended to an additional length of 1.2 meters (m) for 30 minutes by adding and connecting appropriate weights to the bottoms of the telephone cords. Afterwards, the loads (weights) were removed and the bottom ends of the telephone cords retracted upwardly. Five minutes after the load (weight) was released and removed, the recovered lengths of the telephone cords were measured. The recovered length of the telephone cords are indicated in Table 6 below.

TABLE 6

Extension and Recovery

| Example No. | Retractile Telephone Cord | Total Nominal Uncoiled Length (Feet) | Outer Protective Jacket | Recovered Length (mm) |
|---|---|---|---|---|
| 74 | 1 | 6 (1.8288 m) | Polyurethane | 137 |
| 75 | 2 | 12 (3.6576 m) | Polyurethane | 260 |
| 76 | 3 | 25 (7.26 m) | Polyurethane | 670 |
| 77 | 4 | 6 (1.8288 m) | PVC | 201 |
| 78 | 5 | 12 (3.6576 m) | PVC | 335 |
| 79 | 6 | 25 (7.26 m) | PVC | 910 |
| 80 | 7 | 12 (3.6576 m) | Polyurethane + EVA | 336 |
| 81 | 8 | 25 (7.26 m) | Polyurethane + EVA | 654 |

As is evident from Examples 74–81, retractile telephone cords with 100% polyurethane jackets and with composite jackets of polyurethane and ethylene vinyl acetate (EVA) have a smaller recovered length than retractile telephone cords with PVC jackets.

EXAMPLES 82–91

Retractile telephone cords of similar lengths were formed and tested with a polyproylene primary insulation and an outer protective jacket comprising different density polyurethane elastomeric secondary insulation. The hardness, modulus, tensile strength, elongation at break, taper abrasion, and brittleness points of the retractile telephone cords are indicated in Table 7 below.

TABLE 7

Retractile Cords With Different Density Polyurethane Outer Protective Jackets

| Example | No. | 82 | 83 | 84 | 85 | 86 | 87 | 88 | 89 | 90 | 91 |
|---|---|---|---|---|---|---|---|---|---|---|---|
| Hardness | Shore A/D | 80A | 85A | 90A | 95A | 98A | 80A | 85A | 90A | 95A | 98A |
| 100% Modulus | $kgf/cm^2$ | 60 | 80 | 100 | 120 | 150 | 50 | 70 | 90 | 110 | 140 |
| Tensile Strength | $kgf/cm^2$ | 350 | 380 | 400 | 420 | 440 | 360 | 380 | 420 | 430 | 440 |
| Elongation at Break | % | 640 | 600 | 550 | 460 | 450 | 650 | 600 | 580 | 520 | 500 |
| Taper Abrasion | mg | 30 | 30 | 30 | 25 | 25 | 30 | 30 | 30 | 25 | 25 |

TABLE 7-continued

| Retractile Cords With Different Density Polyurethane Outer Protective Jackets | | | | | | | | | | | |
|---|---|---|---|---|---|---|---|---|---|---|---|
| Example | No. | 82 | 83 | 84 | 85 | 86 | 87 | 88 | 89 | 90 | 91 |
| Brittleness Point | ° C. | <−50 | <−50 | <−50 | <−40 | <−40 | <−50 | <−50 | <−50 | <−50 | <−40 |

Examples 82–91 indicate that the hardness, modulus, tensile strength, elongation at breaking point, taper abrasion, and brittleness point varied with the type of polyurethane used. Example 85 had the most preferred qualities in Table 7.

In some circumstances, it may be desirable that the primary insulation comprise: polyurethane, polyurethane-diisocyanate, urethane, polyethylene, polyvinyl chloride, polysulfone, polystyrene, neoprene, butadiene, styrene butadiene rubber, vulcanized Hevea, Buna S, butyl rubber, natural rubber (polyisoprene), acrylonitrile-butadiene, silicone, polysiloxane, chlorsulfanated polyethylene, nylon (polyamide), crystalline thermoplastic elastomer, or other plastic insulating material.

Furthermore, in some circumstances, it may be desirable that the outer protective jacket providing the secondary insulation, comprises: polytetrafluoroethylene (PTFE) (Teflon), polypropylene, , polyethylene, polyvinyl chloride, polysulfone, polystyrene, neoprene, butadiene, styrene butadiene rubber, vulcanized Hevea, Buna S, butyl rubber, natural rubber (polyisoprene), acrylonitrile-butadiene, silicone, polysiloxane, chlorsulfanated polyethylene, nylon (polyamide), or other plastic insulating material.

The dielectric constant, power factor, volume resistivity, surface resistivity, and dielectric strength of some of the preceding rubber and elastomeric insulators are shown in Table 8 below.

TABLE 8

| Properties of Rubbers and Elastomeric Insulators | | | | | |
|---|---|---|---|---|---|
| Material | Di-electric constant, $10^6$ Hz | Power factor X $10^2$, $10^6$ Hz | Volume resistivity, Ω · cm | Surface resistivity, Ω | Di-electric strength, V/mil |
| Natural rubber | 2.7–5 | 0.05–0.2 | $10^{15}$–$10^{17}$ | $10^{14}$–$10^{15}$ | 450–600 |
| Styrene-butadiene rubber | 2.8–4.2 | 0.5–3.5 | $10^{14}$–$10^{16}$ | $10^{13}$–$10^{14}$ | 450–600 |
| Acrylonitrile-butadiene rubber | 3.9–10.0 | 3–5 | $10^{12}$–$10^{15}$ | $10^{12}$–$10^{15}$ | 400–500 |
| Butyl rubber | 2.1–4.0 | 0.3–8.0 | $10^{14}$–$10^{16}$ | $10^{13}$–$10^{14}$ | 400–800 |
| Chlorosulfonated polyethylene | 5.0–11.0 | 2.0–9.0 | $10^{13}$–$10^{17}$ | $10^{14}$ | 400–600 |
| Polyurethane | 5.0–8.0 | 3.0–6.0 | $10^{10}$–$10^{11}$ | | 450–500 |

The dielectric constants at different frequencies for some of the preceding insulators are shown in Table 9 below.

TABLE 9

| Dielectric Constants of Insulators at Different Frequencies | | | | |
|---|---|---|---|---|
| | | Frequency (Hertz) | | |
| Material | ° C. | $1 \times 10^3$ | $1 \times 10^6$ | $1 \times 10^8$ |
| Polyamide resins: | | | | |
| Nylon 66 | 25 | 3.75 | 3.33 | 3.16 |
| Nylon 610 | 25 | 3.50 | 3.14 | 3.0 |
| Polyethylene | −12 | 2.37 | 2.35 | 2.33 |
| | 23 | 2.26 | 2.26 | 2.26 |
| Polyvinyl chloride | 25 | 4.55 | 3.3 | |
| Polystyrene | 2.5 | 2.54–2.56 | 2.54–2.56 | 2.55 |
| | 80 | 2.54 | 2.54 | 2.54 |
| Hevea, vulcanized | 27 | 2.94 | 2.74 | 2.42 |
| Buna S | 20 | 2.66 | 2.56 | 2.52 |
| Butyl rubber compound | 25 | 2.42 | 2.40 | 2.39 |
| Neoprene | 24 | 6.60 | 6.26 | 4.5 |
| Silicon rubber | 25 | 3.12–3.30 | 3.10–3.20 | 3.06–3.18 |

The dielectric constants and dissipation factors (loss) for some of the preceding insulators are shown in Table 10 below.

TABLE 10

| Dielectric Constants and Dissipation Factors of Insulators | | |
|---|---|---|
| Material | Dielectric constant At $10^6$ Hz | Dissipation Factor at $10^6$ Hz |
| PTFE, (Teflon) | 2.0 | 0.0002–0.0003 |
| Nylon 6 and nylon 10 | 3.5–3.6 | 0.04 |
| Polypropylene | 2.20–2.28 | 0.0002–0.002 |
| Silicones | 3.4–4.3 | 0.001–0.004 |

The arc resistance, dielectric constants, dissipation factors, dielectric strength, volume resistivity, tensile strength, tensile modulus, elongation, compressive strength, flexural strength, impact strength, hardness, heat distortion, coefficient for thermal expansion, thermal conductivity, and flammability for some of the preceding insulators are shown in Table 11 below.

TABLE 11

| Material | Poly ethylene, low-density | Poly ethylene, med-density | Poly ethylene, high-density | Poly propylene | Poly styrene | Poly sulfone | Poly vinyl chloride | Tetra fluoro ethylene |
|---|---|---|---|---|---|---|---|---|
| | Properties of Insulators | | | | | | | |
| Electrical properties: | | | | | | | | |
| Arc resistance | 140 | 200 | 200 | 185 | 100 | 122 | 80 | >200 |
| Dielectric constant | | | | | | | | |
| 60 Hz | 2.4 | 2.4 | 2.4 | 2.6 | 3.4 | 3.1 | 3.6 | 2.1 |
| $10^6$ Hz | 2.4 | 2.4 | 2.4 | 2.6 | 3.2 | 3.1 | 3.3 | 2.1 |
| $10^9$ Hz | 2.4 | 2.4 | 2.4 | 2.6 | 3.1 | 3.1 | 3.4 | 2.1 |
| Dissipation factor | | | | | | | | |
| 60 Hz | <0.0005 | <0.0005 | <0.0005 | <0.0005 | 0.0004 | 0.0008 | 0.007 | <0.0002 |
| $10^6$ Hz | <0.0005 | <0.0005 | <0.0005 | <0.0005 | 0.0004 | 0.001 | 0.009 | <0.0002 |
| $10^9$ Hz | <0.0005 | <0.0005 | <0.0005 | <0.0005 | 0.0004 | 0.005 | 0.006 | <0.0002 |
| Dielectric strength, V/mil step by step | 420 | 500 | 550 | 450 | 300 | 400 | 3.75 | 430 |
| Volume resistivity, $\Omega \cdot$ cm | $10^{16}$ | $10^{16}$ | $10^{16}$ | $10^{16}$ | $10^{16}$ | $10^{17}$ | $10^{16}$ | $10^{18}$ |
| Mechanical properties: | | | | | | | | |
| Tensile strength, lb/in.$^2$ | 2,300 | 3,500 | 5,500 | 5,500 | 6,800 | 10,200 | 9,000 | 4,500 |
| Tensile modulus, lb/in.$^2$ $\times 10^5$ | 0.35 | 0.55 | 1.5 | 2.3 | 4.5 | 3.6 | 6.0 | 0.58 |
| Elongation, % | 800 | 600 | 100 | 700 | 80 | 100 | 40 | 400 |
| Flexural strength, lb/in.$^2$ | 7,000 | 1,000 | 8,000 | 10,000 | 15,400 | 16,000 | | |
| Impact strength, ft lb/m of notch | No break | >16 | 20 | 1.5 | 8 | 1.3 | 20 | 3.0 |
| Hardness, Rockwell | | | | R110 | R100 | R120 | | |
| Thermal properties: | | | | | | | | |
| Heat-distortion temp. at 264 lb/in$^2$ | 105 | 120 | 120 | 145 | 205 | | 164 | >250 |
| Maximum-use temp., ° F. | 212 | 250 | 250 | 320 | 175 | | 175 | 550 |
| Coefficient of thermal expansion, ° C.$^{-1} \times 10^{-5}$ | 18 | 16 | 13 | 10 | 21 | 6 | 18 | 10 |
| Thermal conductivity, cal/S-cm ° C. | 8.0 | 10.0 | 12.4 | 2.8 | 3.0 | 6.2 | 7.0 | 6 |
| Flammability, in./min | 1.04 | 1.04 | 1.04 | 1.04 | 1.0 | No burn | No burn | No burn |

Among the many advantages of the modular retractile telephone cords of the present invention are:

1. Superior performance.
2. Reduced sagging.
3. Smaller relaxed retracted and recovered lengths.
4. Excellent space saver.
5. Better visual appeal.
6. Simple to install.
7. Easy to use.
8. Less obtrusive.
9. Compact.
10. Convenient.
11. Attractive.
12. User friendly.
13. Strong.
14. Economical.
15. Reliable.
16. Safe.
17. Efficient.
18. Effective.

Although embodiments have been shown and described, it is to be understood that various modifications and substitutions, as well as rearrangements of parts and components, can be made by those skilled in the art, without departing from the normal spirit and scope of this invention.

What is claimed is:

1. A telephone cord, comprising:

a modular retractile telephone cord having a composite jacket with opposite ends, said composite jacket comprising polyurethane and ethylene vinyl acetate, and said composite jacket comprising said polyurethane and said ethylene vinyl acetate enclosing a core of 2 to 8 conductors electrically insulated and separated by primary insulation, said cord with said composite jacket comprising said polyurethane and said ethylene vinyl acetate having a coiled portion disposed between said ends, and said coiled portion with said composite jacket comprising said polyurethane and said ethylene vinyl acetate including coils; and at least one modular telephone plug, said plug being connected to one of said ends of said modular retractile telephone cord adjacent said composite jacket comprising said polyurethane and said ethylene vinyl acetate.

2. A telephone cord in accordance with claim 1 wherein:

said composite jacket comprises by weight 80%–90% polyurethane and 10%–20% ethylene vinyl acetate;

said primary insulation comprising an insulating material selected from the group consisting of polypropylene, polyethylene, polyvinyl chloride, neoprene, polyurethane, urethane, butadiene, styrene, natural rubber, polystyrene, polysulfone, vulcanized Hevea, Buna 5, butyl rubber, polyisoprene, styrene-butadiene, acrylonitrile-butadiene, chlorosulfanated polyethylene, silicone, polysiloxane, nylon, and crystalline thermoplastic elastomer; and said modular retractile telephone cord comprises a modular cord selected from the group consisting of a telephone handset cord, a telephone headset cord, a telephone vehicle cord, a telephone computer cord, and a telephone modem cord.

3. A telephone cord in accordance with claim 2 wherein:

said composite jacket comprises by weight: 50%–99% polyurethane and 1%–50% ethylene vinyl acetate; and said modular retractile telephone cord is selected from the group consisting of a 6 ft. (1.8288 m) cord, a 12ft. (3.6576 m) cord, and a 25 ft. (7.62 m) cord.

4. A telephone cord in accordance with claim 1 wherein said maximum outside coil diameter is at least one inch (24.5 mm).

5. A telephone cord in accordance with claim 1 wherein said conductors are selected from the group consisting of; flexible conductors comprising tinsel ribbons, substantially parallel strands of wire, and twisted strands; and said composite jacket having a maximum outside diameter greater than 0.75 inches (19.05 mm) and comprising by weight 80%–90% polyurethane and 10%–20% ethylene vinyl acetate.

6. A telephone cord in accordance with claim 1 wherein said composite polyurethane jacket has a coating comprising an elastomeric material.

7. A telephone cord in accordance with claim 1 wherein said coils have substantially the same maximum outside coil diameter.

8. A telephone cord in accordance with claim 1 wherein said coils have different maximum outside coil diameters.

9. A telephone cord, comprising:

a retractile telephone cord having opposite ends and a coiled portion positioned between said opposite ends, said coiled portion having spiral coils, said retractile telephone cord comprising;

a core comprising 2 to 8 conductors;

primary insulation for electrically insulating and separating said conductors, said primary insulation comprising a primary insulating material selected from the group consisting of polypropylene, polyethylene, polyvinyl chloride, neoprene, polyurethane, urethane, butadiene, styrene, natural rubber, polystyrene, polysulfone, vulcanized Hevea, Buna 5, butyl rubber, polyisoprene, styrene-butadiene, acrylonitrile-butadiene, chlorosulfonated polyethylene, silicone, polysiloxane, nylon, and crystalline thermoplastic elastomer; and a composite jacket annularly surrounding said primary insulation and said core, said composite jacket comprising by weight 50%–99% polyurethane and 1%–50% ethylene vinyl acetate.

10. A telephone cord in accordance with claim 9 wherein:

said retractile telephone cord comprises a modular cord selected from the group consisting of: a telephone handset cord, a telephone headset cord, a telephone vehicle cord, a telephone computer cord, and a telephone modem cord; and said composite polyurethane jacket comprises 80%–90% polyurethane and 10%–20% ethylene vinyl acetate; and said coils have a maximum outside diameter greater than 0.75 inches (19.05 mm).

11. A telephone cord in accordance with claim 9 wherein:

said coils have a maximum diameter greater than one inch (24.5 mm);

said conductors are selected from the group consisting of substantially parallel conductors, twisted conductors, and flexible tinsel conductors; and said retractile telephone cord is selected from the group consisting of a 6 ft. (1.8288 mm) cord, a 12 ft. (3.6576 m) cord, and a 25 ft. (7.62 m) cord.

12. A telephone cord in accordance with claim 9 wherein said coils have about the same maximum outside diameter.

13. A telephone cord in accordance with claim 9 wherein said coiled portion comprises a tapered coiled portion with at least some of said coils having a different maximum outside diameter.

14. A telephone cord, comprising:

a modular retractile telephone cord having a spiral wound coiled portion extending between ends of said cord, said spiral wound coiled portion having spiral coils with a maximum coil diameter greater than 0.75 inches (19.05 mm);

a core comprising 2 to 8 electrical conductors;

primary insulation for electrically insulating and separating said conductors, said primary insulation comprising polypropylene;

a composite jacket comprising secondary insulation for annularly surrounding said primary insulation and said core, said secondary insulation of said composite jacket comprising by weight: 50%–99% polyurethane and 1%–50% ethylene vinyl acetate; and said modular retractile telephone cord having a maximum coil diameter greater than 0.75 inches (19.05 mm) and comprising a modular cord selected from the group consisting of a telephone handset cord, a telephone headset cord, a telephone vehicle cord, a telephone computer cord, and a telephone modem cord; and at least one modular telephone plug, said modular telephone plug having said maximum coil diameter greater than 0.75 inches (19.05 mm) being connected to one of the ends of said modular retractile telephone cord.

15. A telephone cord in accordance with claim 14 wherein:

said composite polyurethane jacket comprises by weight: 80%–90% polyurethane and 10%–20% ethylene vinyl acetate;

said electrical conductors are selected from the group consisting of substantially parallel tinsel conductors and twisted conductors; and said modular retractile telephone cord having said maximum coil diameter greater than 0.75 inches (19.05 mm) is selected from the group consisting of a 12 ft. (3.6576 m) cord and a 25 ft. (7.62 m) cord.

16. A telephone cord in accordance with claim 14 wherein said modular retractile telephone cord comprises a telephone handset cord with a second modular telephone plug connected to the other end of said cord.

17. A telephone cord in accordance with claim 14 wherein said spiral coils have a maximum coil diameter of at least one inch (24.5 mm).

18. A telephone cord in accordance with claim 14 wherein said coils comprise substantially uniform helical coils with substantially the same maximum coil diameter.

19. A telephone cord in accordance with claim 14 wherein:

said spiral wound coil portion comprises a tapered portion;

at least some of said spiral coils in said tapered portion have a different maximum coil diameter; and said modular retractile telephone cord has an external elastomeric layer covering at least a portion of said composite jacket comprising by weight 50%–99% polyurethane and 1%–50% ethylene vinyl acetate.

20. A telephone cord, comprising:

a telephone handset cord for connecting a telephone handset to a base unit, said telephone handset cord comprising a modular retractile telephone cord with a handset-facing end, a base-facing end, and a spiral wound coiled portion extending between said ends, said spiral wound coiled portion comprising spiral coils;

a telephone handset connector comprising a handset-connecting modular plug connected to said handset-facing end of said telephone handset cord for connection to a telephone handset;

a base connector comprising a base-connecting modular plug connected to said base-facing end of said telephone handset cord for connection to a base unit;

said telephone handset cord being biased in a normally relaxed retracted position when the handset is cradled or seated on the base unit;

said telephone handset cord being expandable to an elongated stretched extended position when the handset is moved away from the base unit;

said telephone handset cord having a retracted length in the retracted position and an extended length in the extended position;

said spiral coils having a greater maximum coil diameter and being positioned closer together when said telephone handset cord is in said retracted position;

said spiral coils have a maximum coil diameter greater than 0.75 inches (19.05 mm) when said telephone handset cord is in said retracted position;

said telephone handset cord comprising a cordage assembly with a core comprising 4 to 8 substantially parallel electrical conductors selected from the group consisting of wire, strands, and a flexible tinsel ribbon;

primary insulation for electrically insulating and separating said electrical conductors, said primary insulation comprising polypropylene; and a composite jacket comprising secondary insulation for annularly surrounding and enclosing said primary insulation and said core, said secondary insulation of said composite jacket comprising elastomeric insulating materials comprising by weight about 80%–90% polyurethane and about 10%–20% ethylene vinyl acetate, and said composite polyurethane jacket has a wall thickness greater than 0.1 inches (2.54 mm) and a tensile strength greater than 1200 psi (84,368,35 g/cm$^2$).

21. A telephone cord is accordance with claim 20 wherein the extended length is greater than 5 times the retracted length of said telephone handset cord.

22. A telephone cord is accordance with claim 20 wherein the retracted length is less than 15% of the extended length of said telephone handset cord.

23. A telephone cord is accordance with claim 20 wherein said conductors comprise 26–28 AWG wire.

24. A telephone cord is accordance with claim 20 wherein:

each of said conductors have a diameter ranging from 0.015 inches (0.38 mm) to 0.024 inches (0.61 mm); and said telephone handset cord has a nominal uncoiled total length of 6 feet (1.8288 m), 12 feet (3.6576 m), or 25 feet (7.62 m).

25. A telephone cord is accordance with claim 20 wherein said coils comprise substantially uniform helical coils with substantially the same maximum coil diameter when said telephone handset cord is in said retracted position.

26. A telephone cord is accordance with claim 20 wherein:

said spiral wound coiled portion comprises a tapered portion; and at least some of said spiral coils in said tapered portion have different maximum coil diameters when said telephone handset cord is in said retracted position.

27. A telephone cord is accordance with claim 20 wherein said spiral coils have a maximum coil diameter of at least 0.75 inches (19.05 mm) when said telephone handset cord is in said retracted position.

28. A telephone cord in accordance with claim 20 wherein said spiral coils have a maximum coil diameter of at least one inch (24.5 mm) when said telephone handset cord is in said retracted position.

* * * * *